US006504450B2

(12) United States Patent
Kim et al.

(10) Patent No.: US 6,504,450 B2
(45) Date of Patent: Jan. 7, 2003

(54) SIGNAL PROCESS APPARATUS FOR PHASE-SHIFTING N NUMBER OF SIGNALS INPUTTED THERETO

(75) Inventors: Duk-Yong Kim, Kyungki-Do (KR); Yoon-Bae Lee, Kyungki-Do (KR); Gyu-Sang Hwang, Kyungki-Do (KR); In-Young Lee, Kyungki-Do (KR); Sang-Wook Bang, Kyungki-Do (KR); Chang-Yun Seo, Kyungki-Do (KR); Kyoung-Ho Lee, Kyungki-Do (KR); Sung-Soo Lee, Kyungki-Do (KR); Yoon-Yong Kim, Kyungki-Do (KR); Taek-Dong Kim, Kyungki-Do (KR)

(73) Assignee: KMW Inc., Kyungki-do (KR)

( * ) Notice: Subject to any disclaimer, the term of this patent is extended or adjusted under 35 U.S.C. 154(b) by 0 days.

(21) Appl. No.: 09/798,908

(22) Filed: Mar. 6, 2001

(65) Prior Publication Data

US 2002/0030560 A1 Mar. 14, 2002

(30) Foreign Application Priority Data

| | | |
|---|---|---|
| Aug. 12, 2000 | (KR) | 2000-46813 |
| Nov. 29, 2000 | (KR) | 2000-71756 |
| Dec. 1, 2000 | (KR) | 2000-72294 |

(51) Int. Cl.[7] ..... H01P 1/18
(52) U.S. Cl. ..... 333/156; 333/161

(58) Field of Search ..... 333/161, 156, 333/136

(56) References Cited

FOREIGN PATENT DOCUMENTS

WO WO 96/37922 * 11/1996 ..... H01Q/3/32

* cited by examiner

*Primary Examiner*—Robert Pascal
*Assistant Examiner*—Kimberly Glenn
(74) *Attorney, Agent, or Firm*—Greenblum & Bernstein, P.L.C.

(57) ABSTRACT

A signal process apparatus of the present invention is capable of shifting phases of signals inputted thereto and attenuating the signals, simultaneously. The signal process apparatus includes a dielectric member provided with a first and a second portions, a plurality of transmission lines positioned opposite the dielectric member for transmitting the signals and means for rotating the dielectric member to an axis perpendicular to a surface of the dielectric member which is parallel to the transmission lines. In the signal process apparatus, a dielectric constant of the first portion is different from that of the second portion. Each of the signals is inputted to a corresponding transmission line. After each of the signals is passing through the corresponding transmission line, it has a phase shifted by rotating the dielectric member.

26 Claims, 21 Drawing Sheets

SIGNAL PROCESS APPARATUS FOR PHASE-SHIFTING N NUMBER OF SIGNALS INPUTTED THERETO

FIELD OF THE INVENTION

The present invention relates to a signal process apparatus; and, more particularly, to a signal process apparatus capable of phase-shifting N number of signals inputted thereto, simultaneously.

DESCRIPTION OF THE PRIOR ART

Generally, a communication system needs a signal process apparatus such as a phase shifter for shifting a phase of a signal inputted thereto and an attenuator for attenuating the signal and so on.

Referring to FIG. 1, there is shown a conventional signal process apparatus 100 for shifting the phase of a signal inputted to an input terminal 1.

As shown in FIG. 1, the conventional signal process apparatus 100 includes a hollow housing 3, an input and an output terminals 1, 2 coupled to a side of the hollow housing 3, a zigzag-shaped transmission line 4, disposed inside the hollow housing 3, of which both ends are connected to the input and the output terminals 1, 2, respectively, a dielectric material 5 and a handle 6 coupled to the other side of the hollow housing 3. The dielectric material 5 is capable of moving along the transmission line 4 by rotating the handle 6.

When a signal is inputted to an end of the transmission line 4 through the input terminal 1, the inputted signal is transmitted through the transmission line 4. In this case, an effective transmission length of the inputted signal is changed based on a size of the dielectric material 5 overlapped with the transmission line 4. The size of the overlapped dielectric material 5 is determined by an amount of rotation of the handle 6. After passing through the transmission line 4, the inputted signal has a phase shifted. The phase-shifted signal is outputted to the output terminal 2.

One of the major shortcomings of the above-described conventional signal process apparatus 100 is that it requires a sufficient space to move the dielectric material 5. Specifically, since a size of the space should be larger than that of a space occupied by the transmission line 4, it is difficult to miniature the signal process apparatus 100.

Furthermore, it is impossible to process N number of signals, simultaneously, since the conventional signal process apparatus 100 can process only one signal.

SUMMARY OF THE INVENTION

It is, therefore, an object of the present invention to provide a signal process apparatus for shifting phases of N number of signals inputted thereto, simultaneously, N being a positive integer.

It is another object of the present invention to provide a signal process apparatus for attenuating amplitudes of N number of signals inputted thereto, simultaneously, N being a positive integer.

It is another object of the present invention to provide a signal process apparatus for suppressing passive intermodulation distortion by utilizing an insulating material.

In accordance with one aspect of the present invention, there is provided a signal process apparatus for shifting phases of N number of signals inputted thereto, N being a positive integer, comprising: a dielectric member provided with a first and a second portions, wherein a dielectric constant of the first portion is different from that of the second portion; N number of transmission lines positioned opposite the dielectric member for transmitting the signals, wherein each signal is inputted to one end of a corresponding transmission line; and means for moving the dielectric member with respect to the transmission lines to shift phases of the signals after passing through the transmission lines.

In accordance with another aspect of the present invention, there is provided a signal process apparatus for attenuating amplitudes of N number of signals inputted thereto, N being a positive integer, comprising: a dielectric member provided with a first and a second portions, wherein one of the portions is made of ferrite; N number of transmission lines positioned opposite the dielectric member for transmitting the signals, wherein each signal is inputted to one end of a corresponding transmission line; and means for moving the dielectric member with respect to the transmission lines to give a different phase to each of the signals after passing through the corresponding transmission line.

In accordance with another aspect of the present invention, there is provided a signal process apparatus for phase-shifting a N number of signals inputted thereto, N being a positive integer, comprising: a lower housing provided with a plurality of trenches; a multiple number of substrates, each of the substrates being provided with a transmission line; a plate provided with a number of dielectric members, each of the dielectric member positioned in a corresponding trench with facing to the transmission line in the corresponding trench and provided with a first and a second portions, wherein a dielectric constant of the first portion is different from that of the second portion; and means for moving the plate with respect to the transmission lines to give a different phase to each of the signals after passing through the corresponding transmission line.

BRIEF DESCRIPTION OF THE DRAWINGS

The above and other objects and features of the present invention will become apparent from the following description of the preferred embodiments given in connection with the accompanying drawings, in which.

DETAILED DESCRIPTION OF THE PREFERRED EMBODIMENTS

Figure 1:
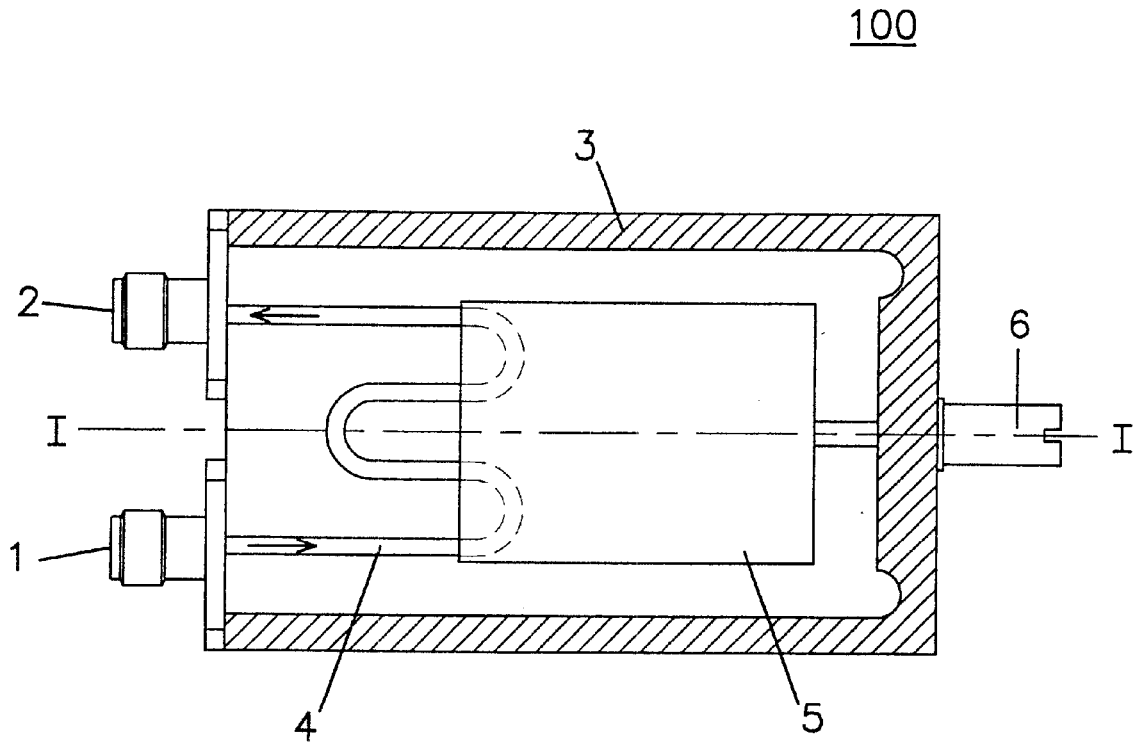
FIG. 1 (PRIOR ART)
FIG. 1 is a cross-sectional view of a conventional signal process apparatus.

Referring to FIGS. 2 to 5, there is shown a signal process apparatus 200 in accordance with a first preferred embodiment of the present invention, comprising an upper housing 101 having a center hole, a disk 135 provided with a shaft 130 on one surface thereof, a semicircular dielectric material 140, a circuit board 160 provided with a first set of transmission lines 151A–154A and a second set of transmission lines 151B–154B and a lower housing 102 provided with two sets 170, 180 of guide holes. In the preferred embodiment, the two sets 170, 180 of guide holes are designed in such a way that the first set 170 is aligned with ends of transmission lines 151A–154A, 151B–154B and the second set 180 is aligned with the other ends of transmission lines 151A–154A, 151B–154B.

Figure 2:
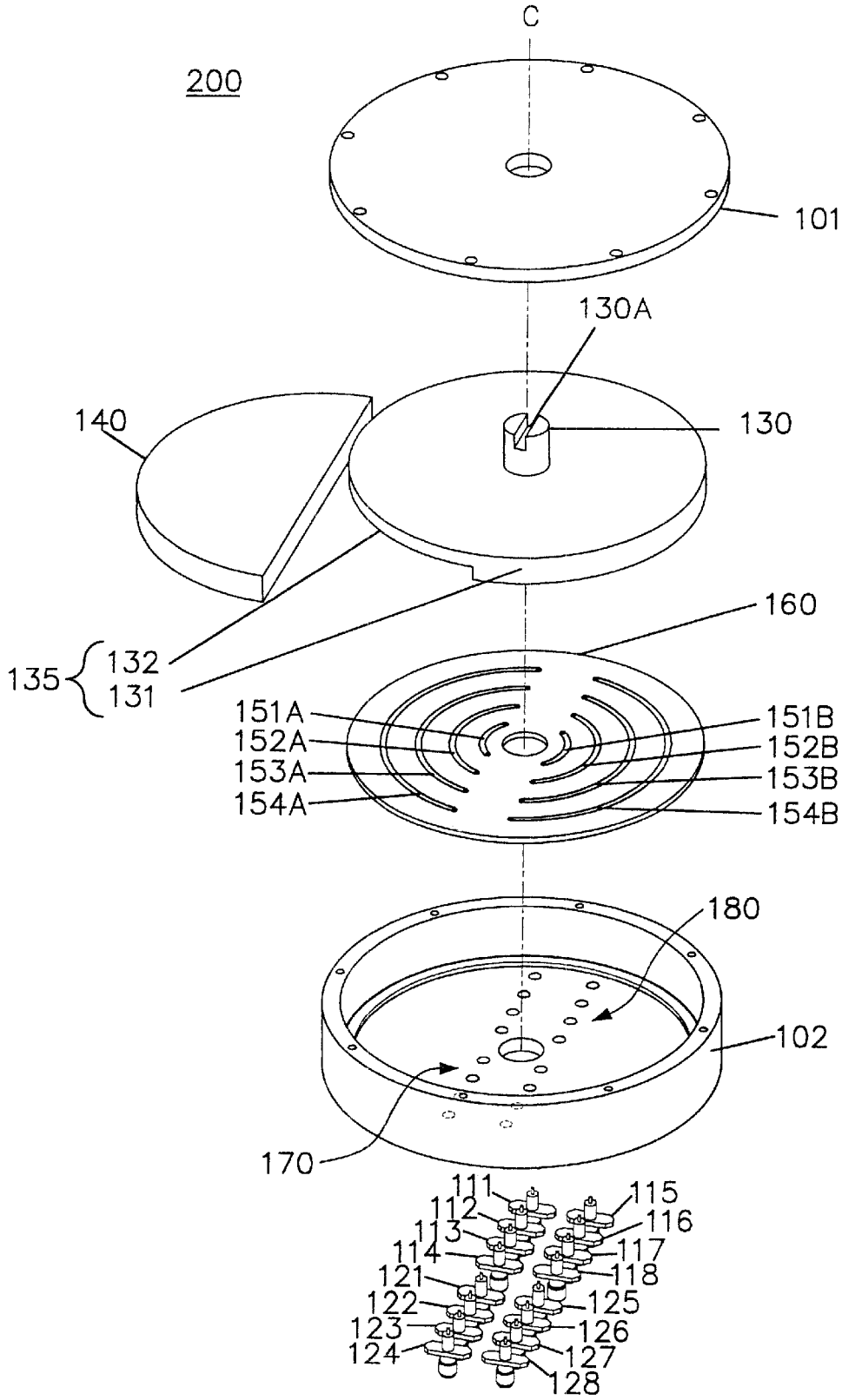
FIG. 2 depicts an exploded view of a signal process apparatus in accordance with a first preferred embodiment of the present invention.

Referring to FIG. 2, the disk 135 is divided into a first section 132 and a second section 131, wherein the thickness of the first section 132 is smaller than that of the second section 131. It is preferable that the second section 131 is designed in such a way that the semicircular dielectric material 140 is easily mounted thereon. In case when the circuit board 160 is in the form of disk, it is preferable that the lower housing 102 is in the shape of cylindrical vessel and the upper housing 101 is also in the shape of disk.

Each of the input connectors 111–118 is electrically connected to ends of the transmission lines 151A–154A, 151B–154B through a corresponding guide hole in the second set 180 for receiving signals inputted thereto. Each of the output connector 121–128 is electrically connected to the other ends of the transmission lines 151A–154A, 151B–154B through a corresponding guide hole in the first set 170 for outputting the signals after passing through the transmission lines 151A–154A, 151B–154B. Further, the connectors 111–118, 121–128 fasten the circuit board 160 to the lower housing 102. The semicircular dielectric material 140 is attached to the first section 132 of the disk 135 and the shaft 130 is inserted into the center hole of the upper housing 101. The shaft 130 is utilized to apply a rotational force to the disk 135.

When signals are inputted into the input connectors 111–118, each of the signals is transmitted to a corresponding transmission line through a corresponding guide hole in the second set 180. Meanwhile, the shaft 130 is rotated by the rotational force applied thereto to rotate the disk 135, whereby the semicircular dielectric material 140 is rotated with respect to an axis perpendicular to a surface thereof and parallel to the transmission lines 151A–154A, 151B–154B. At a top end of the shaft 130, there is a groove 130A for being connected with a power supply (not shown) for providing the rotational force.

Figure 4:
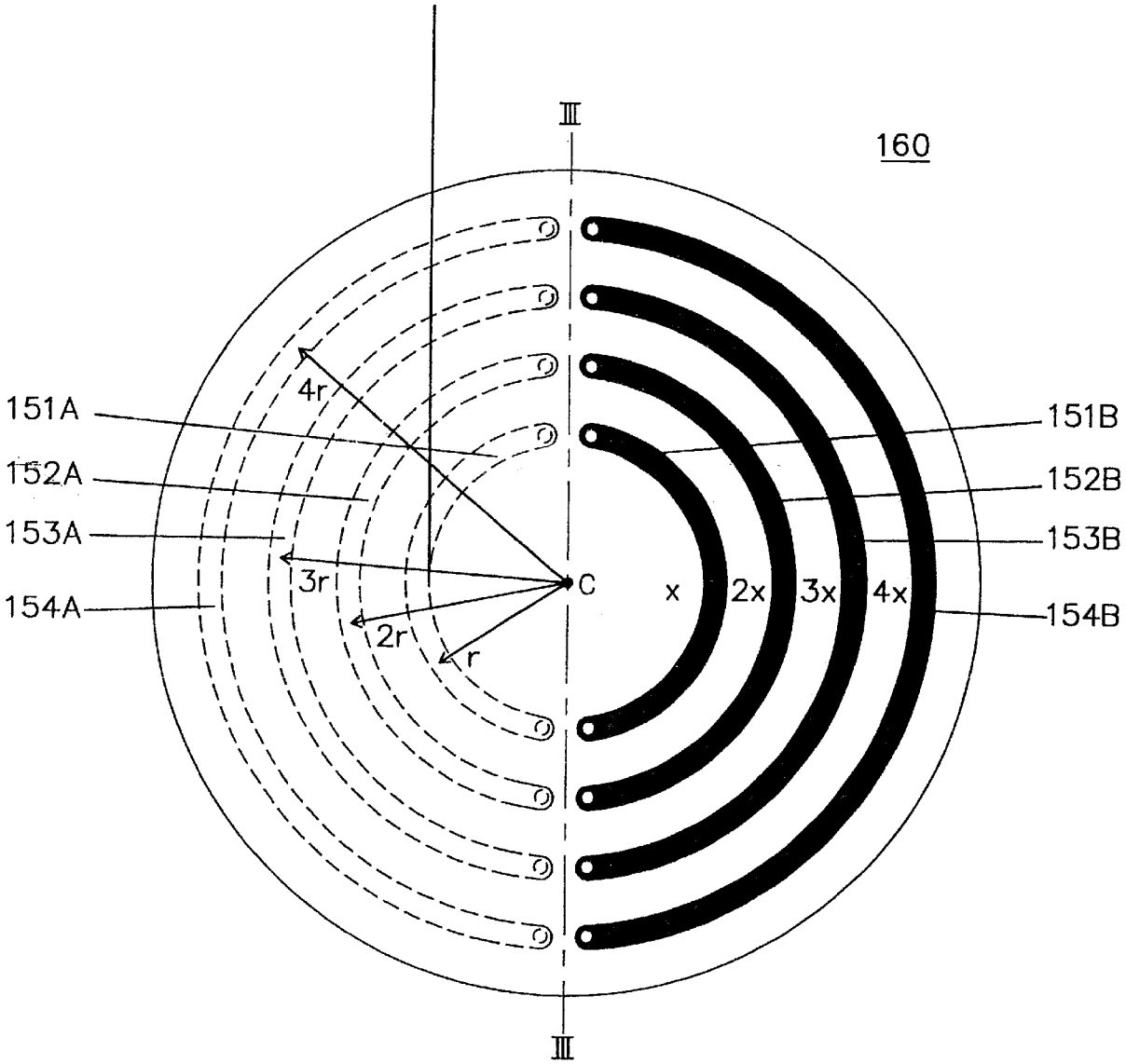
FIG. 4 shows a plan view setting forth a plurality of transmission lines formed on the circuit board in FIG. 2.

Referring to FIG. 4, at first, the transmission lines 151B–154B of the second set is aligned with a line III—III. Since the transmission lines 151A–154A of the first set are symmetric to those 151B–154B of the second set. More specifically, if lengths of the first set of the transmission lines are "x", "2x", "3x" and "4x", those of the second set are also "x", "2x", "3x" and "4x". However, the length ratio of the transmission lines is not limited to a specified value so that it can be selected from anyone of ratios, e.g., x:2x:4x:6x, x:3x:5x:7x, x:1.2x:2x:3x and so on, based on an application of the signal process apparatus 200.

Figure 3:
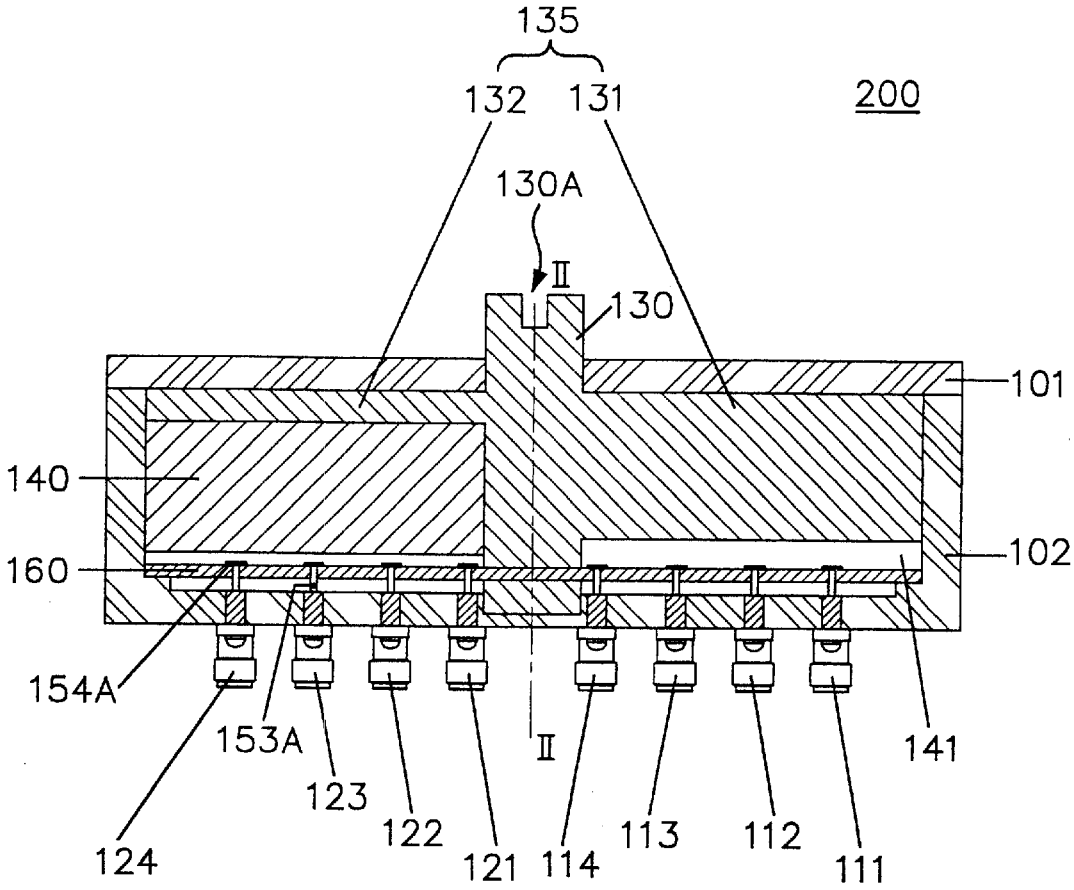
FIG. 3 represents a cross-sectional view of the signal process apparatus of the first preferred embodiment of the present invention.

In case that the semicircular dielectric material 140 is coupled to the first portion 132 of the disk 135, a thickness of the semicircular dielectric material 140 and the first portion 132 after being coupled should be thicker than that of the second portion 131 of the disk 135 to make an air gap between the second portion 131 and the circuit board 160 as shown in FIG. 3. In the preferred embodiment, the semicircular dielectric material 140 is made of a material such as ceramic. Therefore, the disk 135 has two regions, each being of a different dielectric constant.

In other words, when the rotational force rotates the shaft 130, the disk 135 and the semicircular dielectric material 140 are rotated simultaneously. At this time, because the circuit board 160 is fixed to the lower housing 102, two sets of the transmission lines 151A–154A, 151B–154B formed thereon are also fixed without being rotated. The disk 135 is rotated over the circuit board 160; and, therefore, effective electrical lengths of the transmission lines 151A–154A, 151B–154B are changed based on the angle rotated. Hence, the phases of the signals inputted through the input connectors 111–118 are shifted and time delay occurs while the signals are transmitted to the output connectors 121–128 after passing through the transmission lines 151A–154A, 151B–154B. Here, as the time delay increases to a degree at the first set of the transmission lines 151A–154A, it decreases to the same degree at the second set of the transmission lines 151B–154B due to a symmetric arrangement of the transmission lines 151A–154A, 151B–154B.

If the transmission lines 151A–154A of the first set are entirely positioned within the region 141 of air gap, the transmission lines 151B–154B of the second set are entirely positioned within the semicircular dielectric material 140. In this case, the phase shift and the time delay of the signals passing through the transmission lines 151A–154A of the first set become minimum values, but those at the second set 151B–154B become maximum values.

Figure 5:
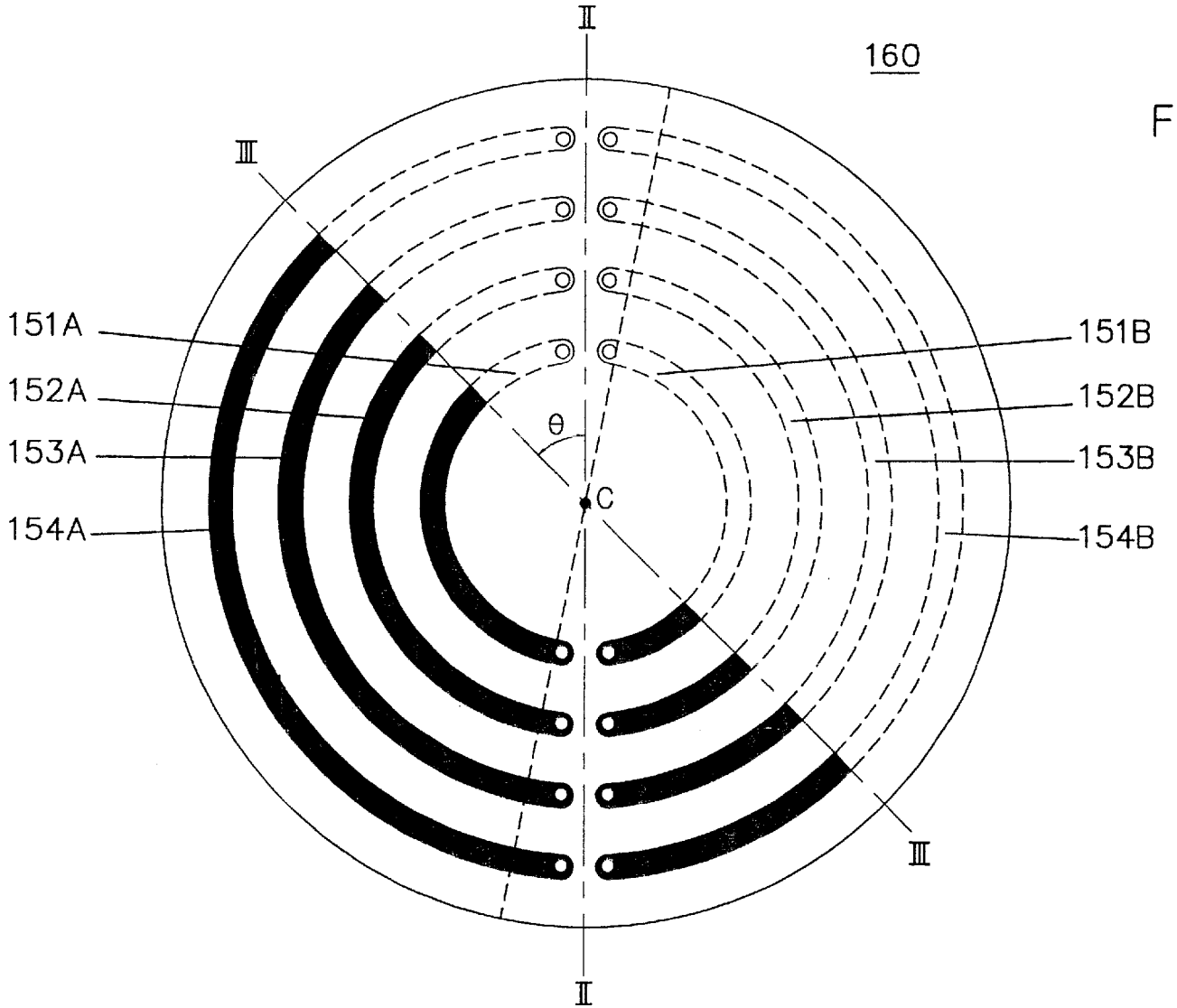
FIG. 5 illustrates a plan view showing the transmission lines after they rotate at a predetermined angle.

Referring to FIG. 5, there is shown the transmission lines in case of the semicircular dielectric material 140 being rotated at a predetermined angle θ. As shown in this figure, it is possible to modulate the phase shift and the time delay between the minimum and maximum values by controlling parts of the transmission lines 151A–154A, 151B–154B overlapped with the semicircular dielectric material 140, 141. Here, the distance of the semicircular dielectric material 140 rotated toward the first set of the transmission lines 151A–154A is identical to that of the region 141 of air gap rotated toward the second set 151B–154B. The rotation angles are identical to each other. Thus, if the electrical lengths of the transmission lines 151A–154A of the first set increase to a predetermined degree, those of the second set decrease to the predetermined degree, simultaneously.

Furthermore, if the semicircular dielectric material 140 is a material such as ferrite, the signal process apparatus 200 can be used as an absorber capable of attenuating amplitudes of the signals inputted thereto. Namely, while the signals inputted through the input connectors 111–118 are transmitted through the transmission lines 151A–154A, 151B–154B, the inputted signals are absorbed by the absorber so that the signals are attenuated simultaneously by a predetermined rate.

Referring to FIGS. 6 to 12, there is shown a signal process apparatus 300 in accordance with a second preferred embodiment of the present invention. The signal process apparatus 300 of the second preferred embodiment is similar to that of the first preferred embodiment shown in FIGS. 2 to 5 except that the design of the circuit board 370 and the dielectric materials 401, 402 and the arrangement of input connectors 311–318 and output connectors 321–328.

Figure 10A:
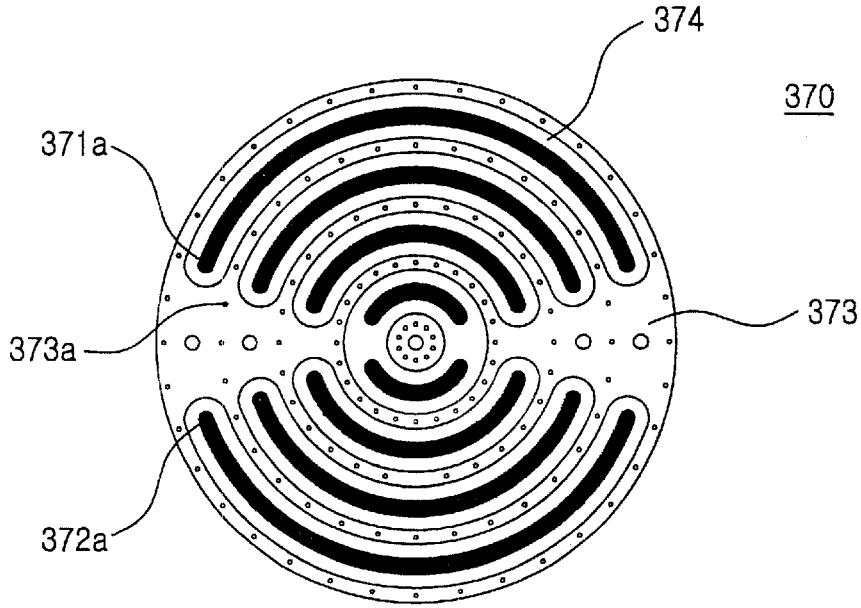
FIGS. 10A and 10B illustrate a top and a bottom view of the circuit board shown in FIG. 6.
Figure 10B:
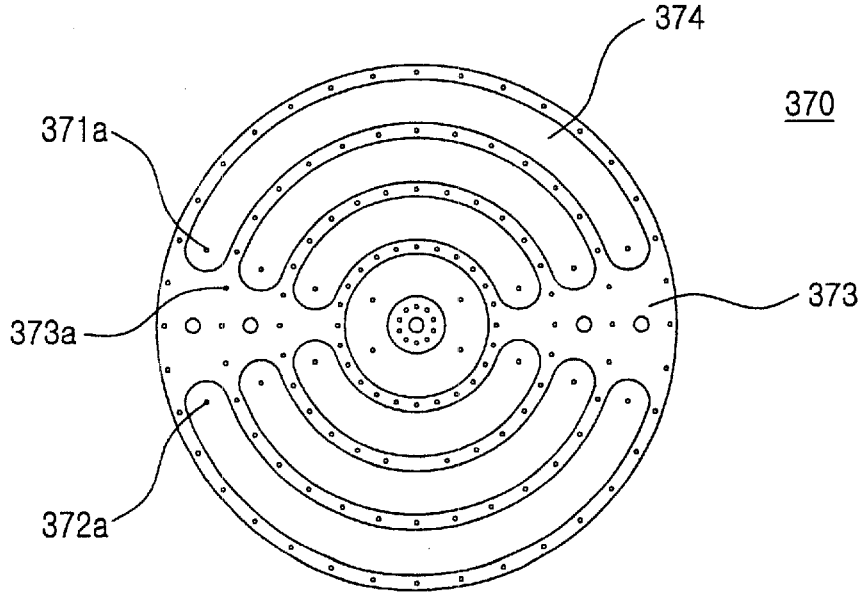
Figure 11:
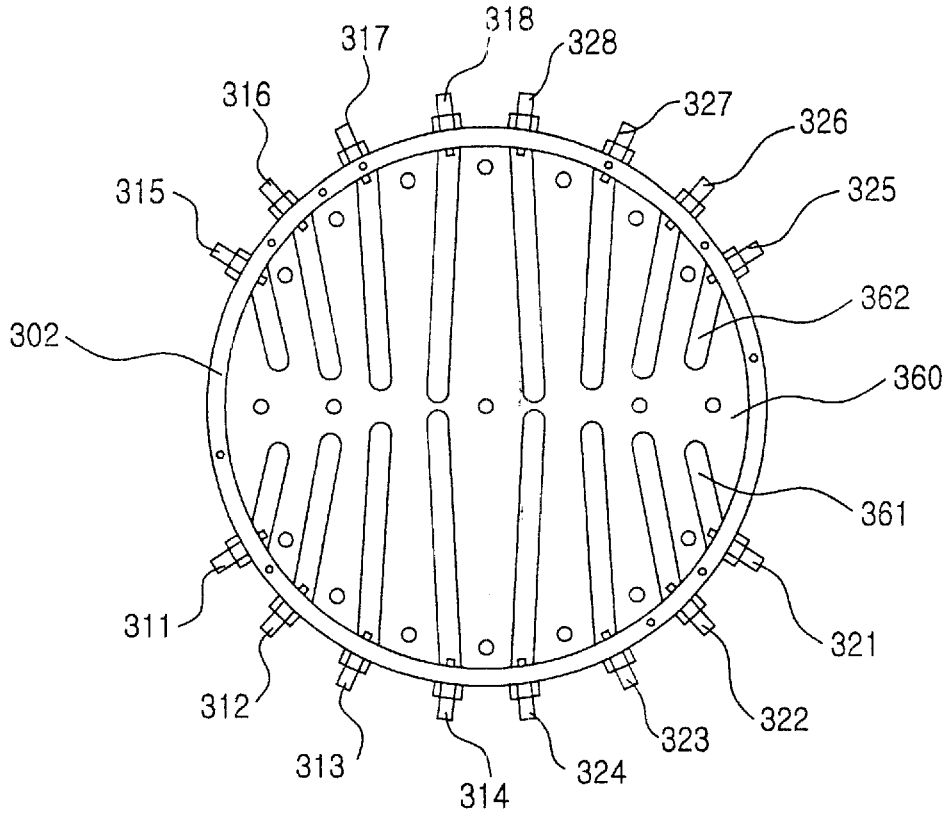
FIG. 11 depicts a plan view showing an arrangement of input and output connectors.
Figure 12:
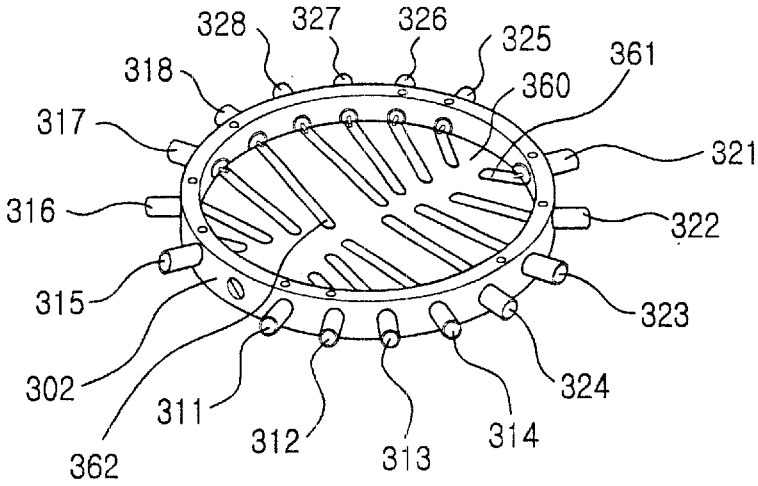
FIG. 12 shows a perspective view setting forth the arrangement of input and output connectors.

In the second preferred embodiment, the circuit board 370 is provided with a plurality of transmission lines 371, 372, a number of closed loops 374 for electrically isolating the transmission lines 371, 372 and a multiple number of contact holes 373*a* to electrically connect a top surface of the circuit board 370 to a bottom surface of the circuit board 370. It is preferable that the transmission lines 371, 372 and the contact holes 373*a* are made of aluminum (Al) or copper (Cu). The top and the bottom surface of the circuit board 370 is coated with a conducting material such as Al or Cu to form ground plates 373 on the top and the bottom surfaces, as shown in FIGS. 10A and 10B. Each of the ground plates 373 is electrically connected to each other through the contact holes 373*a* to thereby serve the ground plates 373 as a ground.

Figure 6:
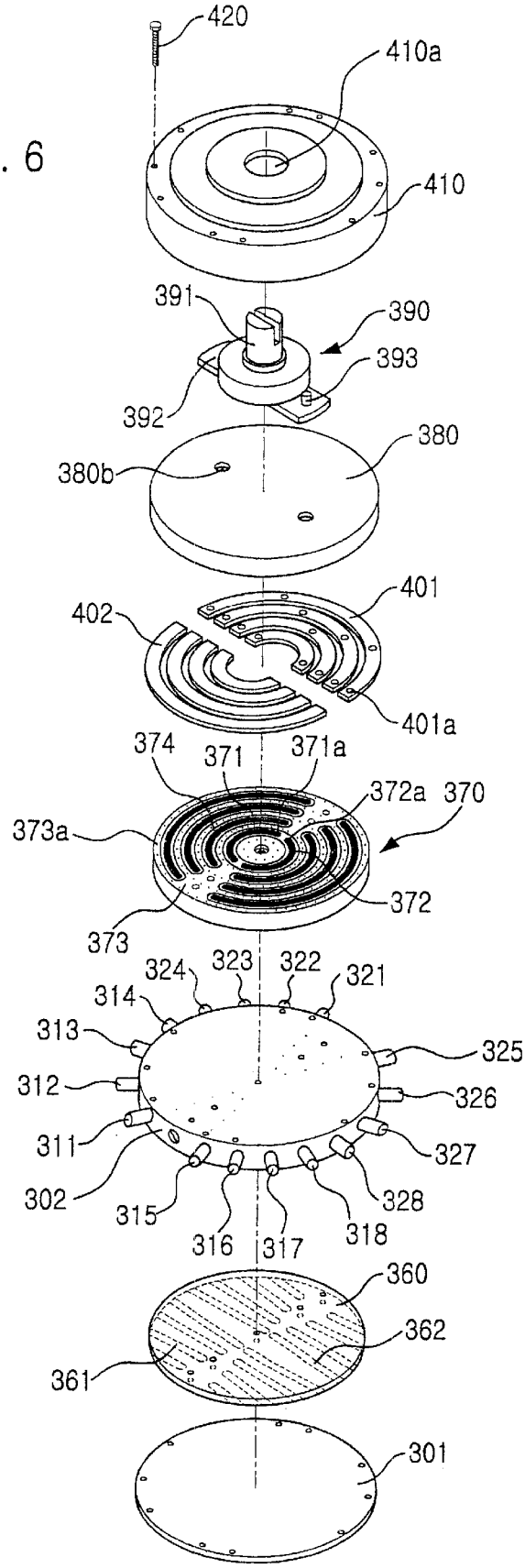
FIG. 6 depicts an exploded view of a signal process apparatus in accordance with a second preferred embodiment of the present invention.
Figure 7:
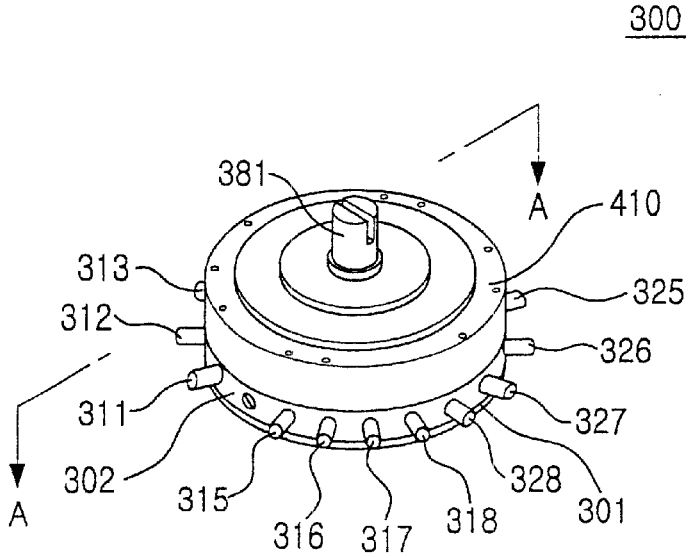
FIG. 7 represents a perspective view of the signal process apparatus after assembling the elements shown in FIG. 6.

Referring to FIGS. 6 and 7, the lower housing 302 is provided with a plurality of input and output connectors 311–318, 321–328 at a side surface thereof. The lower housing 302 further includes a plurality of conducting lines 361, 362 at a bottom surface thereof to electrically connect the transmission lines 371, 372 to a corresponding input/output connector.

Figure 9A:
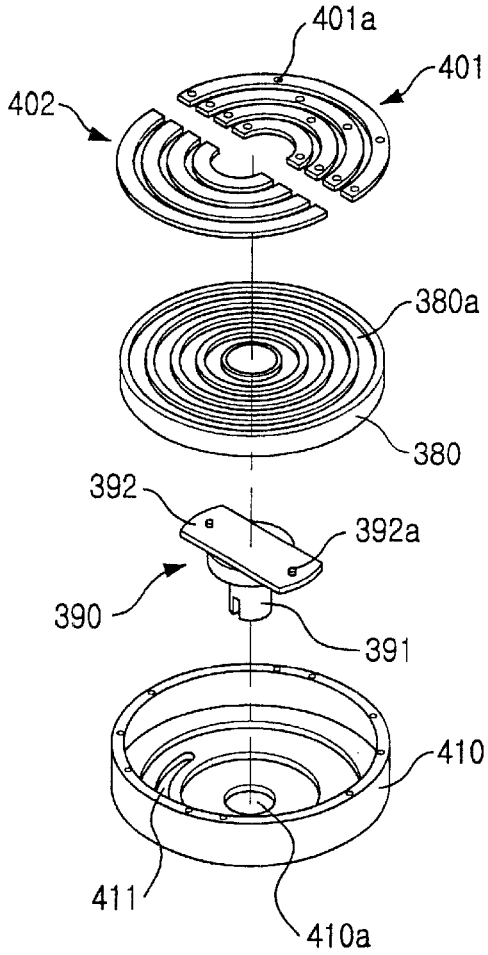
FIGS. 9A and 9B show a partial exploded view of the signal process apparatus and a perspective view representing the assembly thereof.
Figure 9B:
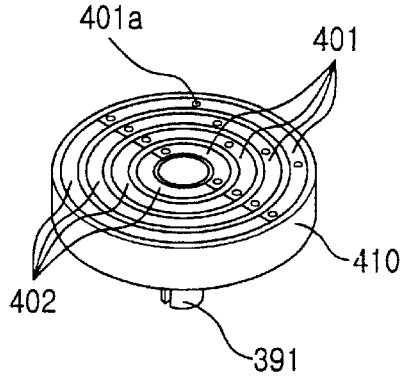

Referring to FIGS. 9A and 9B, there is shown a plate 380 including a number of grooves in the form of ring for attaching a first group 401 of dielectric strips and a second group 402 of dielectric strips. In the second preferred embodiment, it is preferable that the plate 380 is made of a conductive material such as Cu. The dielectric strips of the first group 401 are made of ceramic doped with a material such as Al and the dielectric strips of the second group 402 are made of a material such as ceramic. The dielectric strips in the first group 401 are fastened to the plate 380 with joining a number of screws 401*a*, whereas the dielectric strips in the second group 402 are attached to the plate 380 with an adhesive.

Figure 8:
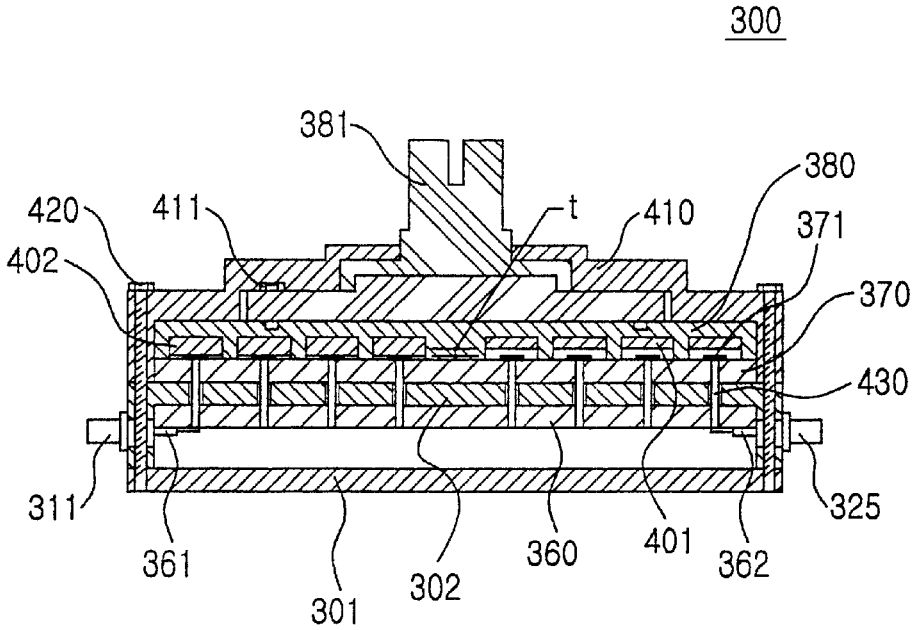
FIG. 8 is a cross-sectional view of the signal process apparatus taken along a line A-A of FIG. 7.

Referring to FIG. 8, each of the transmission lines 371, 372 is electrically shielded each other to prevent signals inputted thereto from interfering each other.

If the dielectric material is made of ferrite, the signal process apparatus 300 can be also utilized as an attenuator. And also, the signal process apparatus 300 can stuff the dielectric strip half portion of the grooves 380*a* in that the plate 380 makes two regions thereof having a different dielectric constant.

Figure 13:
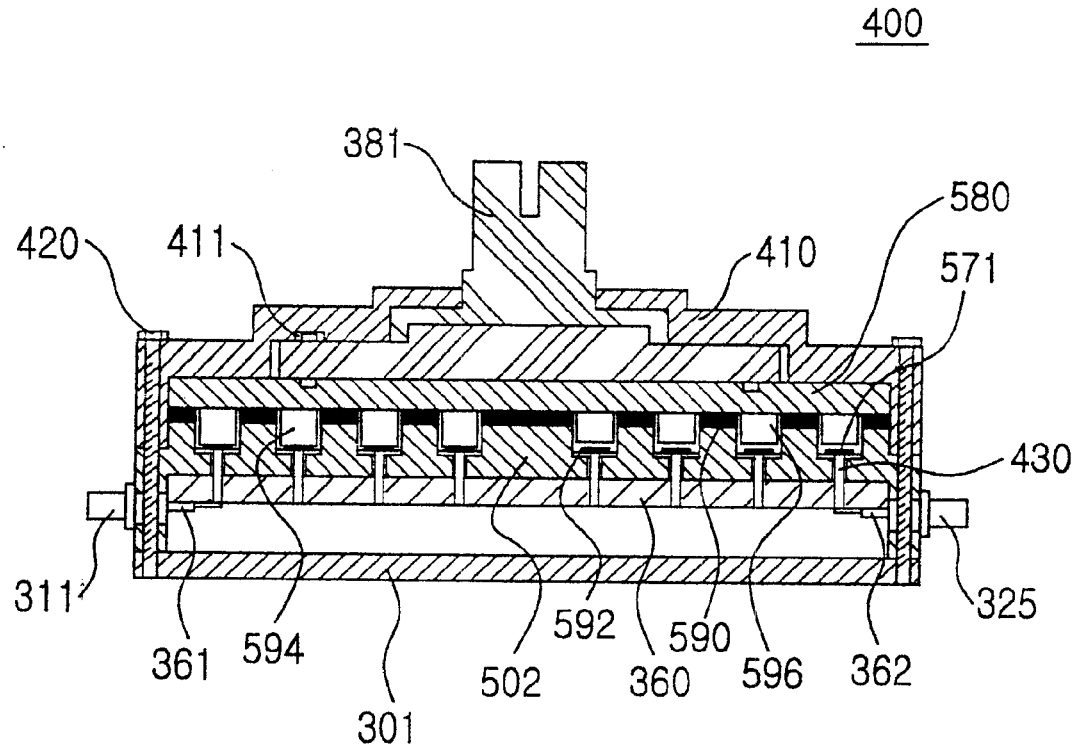
FIG. 13 represents a cross-sectional view of the signal process apparatus in accordance with a third preferred embodiment of the present invention.
Figure 14:
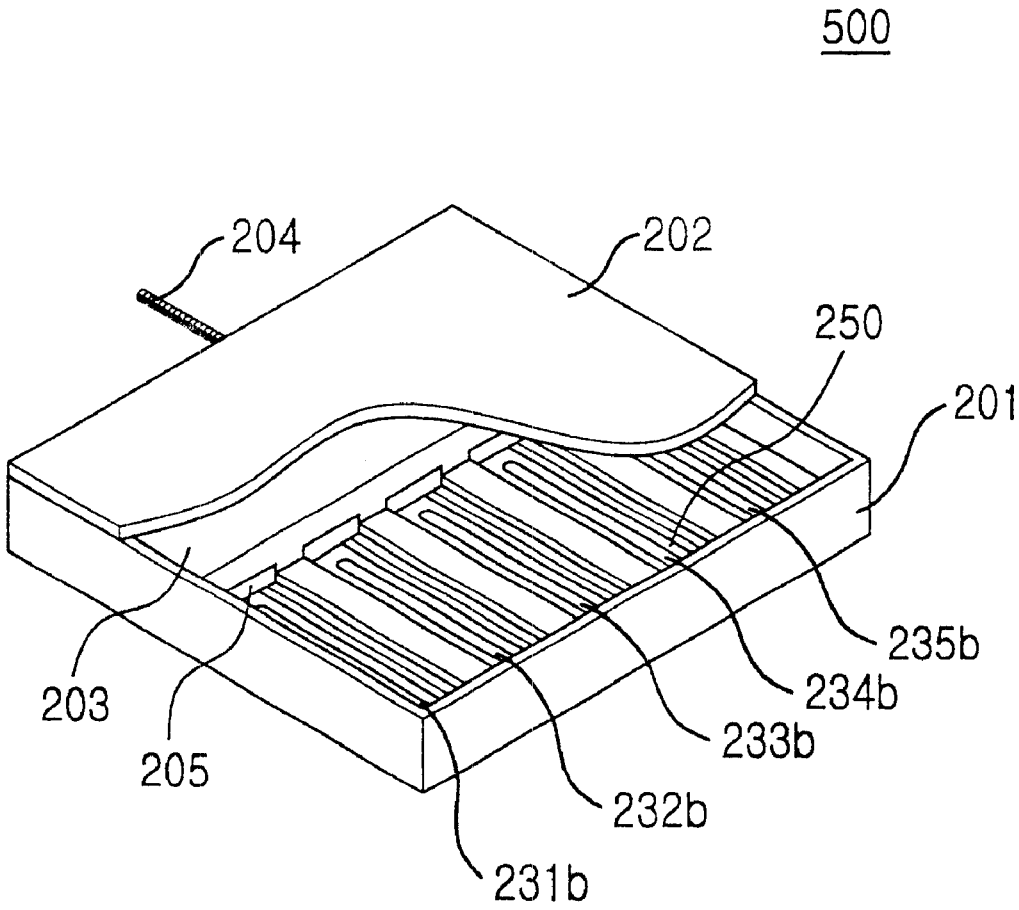
FIG. 14 is a perspective view of a signal process apparatus in accordance with a fourth preferred embodiment of present invention.
Figure 15:
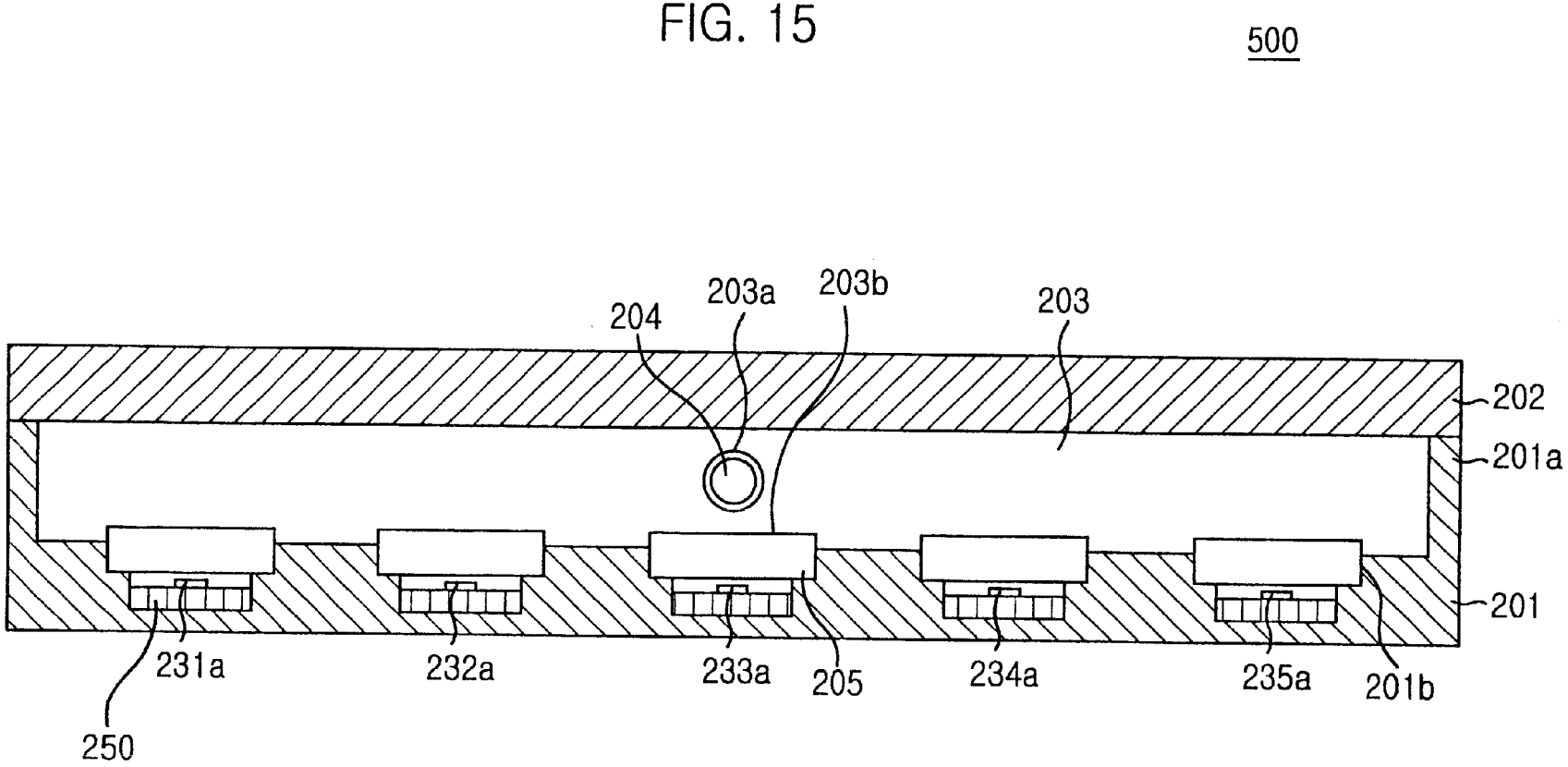
FIG. 15 is a cross sectional view of the signal process apparatus of the fourth preferred embodiment of the present invention.
Figure 16:
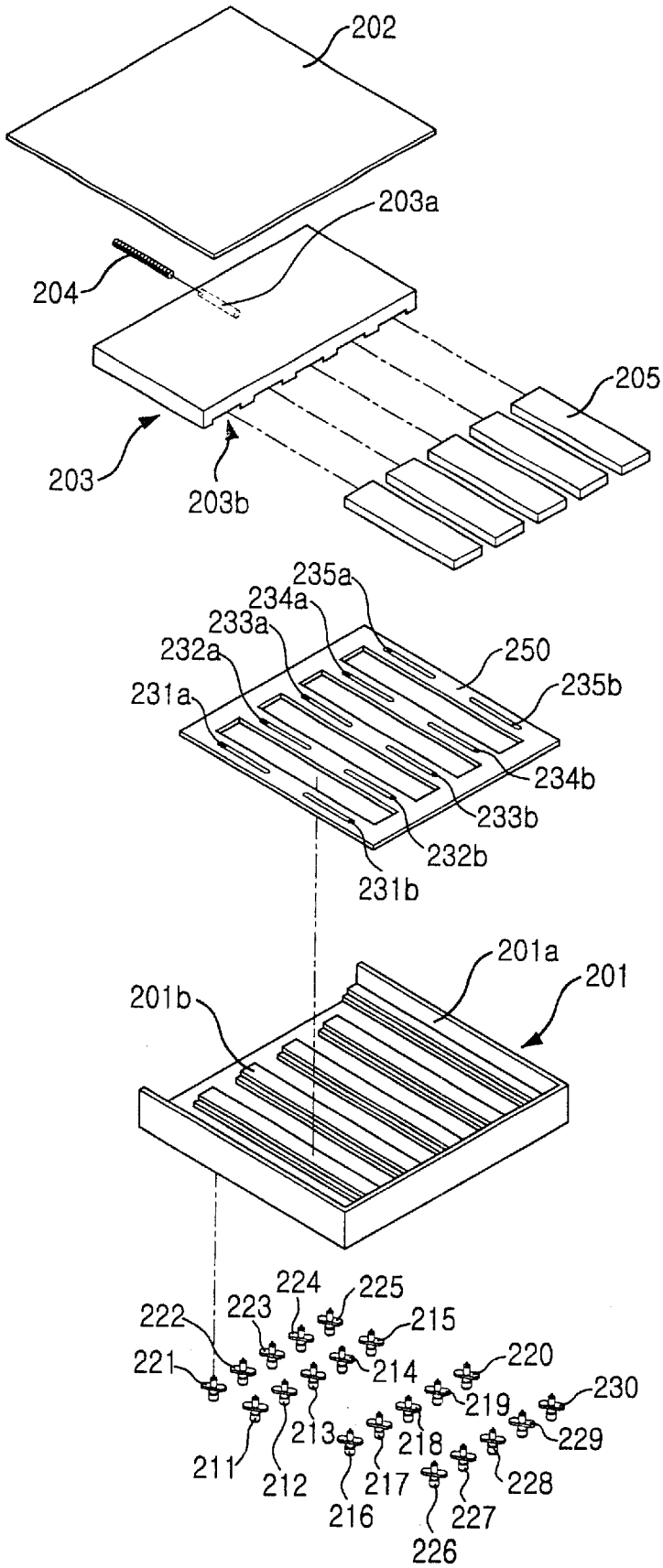
FIG. 16 is an exploded perspective view of the signal process apparatus of the fourth preferred embodiment of the present invention.

Referring to FIG. 13, there is shown a signal process apparatus 400 in accordance with a third preferred embodiment of the present invention. In comparison with the first and the second embodiments, the third embodiment is capable of suppressing a passive inter-modulation distortion (PIMD) by incorporating an insulating layer between a lower housing 502 and a plate 580.

In the third preferred embodiment, the lower housing 502 includes a number of trenches in the form of ring for attaching a plurality of substrates 592. The lower housing 502 is made of a material such as Cu or Al. Each of the substrates 592 is in the form of ring to easily be inserted into a corresponding trench. It is possible that each of the substrates is in the form of half-circle. Each of the substrates 592 is provided with a transmission line 571 to transmit a signal inputted thereto. It is preferable that each of the transmission line 571 is in the form of half-circle. On the other hand, the plate 580 is in the form of disk and a first group of dielectric strips 594 and a second group of dielectric strips 596 are attached in such a way that they are aligned with a corresponding transmission line after assembling. In this embodiment, it is preferable that the plate 580 is made of a conductive material such as Cu. The dielectric strips 594 of the first group are made of ceramic doped with a material such as Al and the dielectric strips 596 of the second group are made of a material such as ceramic. The dielectric strips 594 in the first group are fastened to the plate 580 with joining a number of screws, whereas the dielectric strips 596 in the second group are attached to the plate 580 with an adhesive. The dielectric strips 594 of the first group have a dielectric constant different from those 596 of the second group. Preferably, each of the dielectric strips 596 is in the form of half-circle.

In the signal process apparatus 400, an insulating layer 590 is disposed between the lower housing 502 and the plate 580 to electrically isolating therebetween. Each of the transmission lines 571 is shielded with the lower housing 502, respectively. In this case, since the lower housing 502 serves as a ground and it does not have an interface, the third preferred embodiment can reduce PIMD caused by a metal interface between the ground plates 373 and the plate 380 in the first and the second embodiments.

If the dielectric strips 596 are made of ferrite, the signal process apparatus 400 can be also utilized as an attenuator. The signal process apparatus 400 can use only half portion of the trenches with the dielectric strips 596. In this case, the remaining portion of the trenches remains empty to form air gaps. Therefore, the signal process apparatus 400 obtain two regions, which have a dielectric constant different from each other.

Referring to FIGS. 14 to 16 and 17A to 17C, there is shown a signal process apparatus 500 in accordance with a fourth preferred embodiment of the present invention, comprising an upper housing 202 formed in the shape of a rectangular plate, a lower housing 201 formed in the shape of a rectangular vessel, a plurality of input connectors 211–220, disposed on a base portion of the lower housing 201, a plurality of output connectors 221–230, disposed on the other base portion of the lower housing 201, a mobile plate 203 provided with grooves 203B and a screw hole 203A therein, in which the grooves 203B are formed beneath a bottom portion of the mobile plate 203 and the screw hole 203A is formed inside a side portion thereof, a transportation shaft 204 which is inserted into the screw hole 203A, for supplying a driving force to move the mobile plate 203 linearly, a circuit board 250 provided with a plurality of linear transmission lines 231A–235A, 231B–235B thereon which are formed symmetrically for transmitting inputted signals to the output connectors 221–230, and a dielectric materials 250 which are inserted into the grooves 103B of the mobile plate 203, for modulating electrical lengths of the transmission lines 231A–235A, 231B–235B. The mobile plate 203 moves along guide rails 201A of the lower housing 201 which is formed both inner sides of the lower housing 201. And the grooves 203B are coupled to the dielectric materials 205 and the screw hole 203A is coupled to the transportation shaft 204.

By structuring above, a lower part where the mobile plate 203 is positioned (hereinafter, referred to as a first dielectric portion) has a dielectric constant of the dielectric material 205 and the other lower part where the mobile plate 203 is not positioned (hereinafter, referred to as a second dielectric portion) has a dielectric constant of air. Therefore, the fourth embodiment of the present invention is capable of being used as a phase shifter for modulating the phases of multi-signals simultaneously.

In the fourth embodiment of the present invention, the mobile plate 203 can move linearly along the guide rail 201A by a rotational force of the transportation shaft 204, but it is not limited to this case. That is, the other method, e.g., rack/pinion, worm gear or the like, can be employed to supply the mobile plate to move linearly.

The mechanism of the fourth embodiment is illustrated in more detail hereinafter. When the transportation shaft 204 is rotated by the outer power supplying equipment (not shown), the mobile plate 203 moves linearly along the guide rails 201A so that electrical lengths of the transmission lines 231A–235A, 231B–235B are changed continuously. That is, phases of the inputted signals are shifted and the time delay occurs while the signals are transmitted into the output connectors after passing through the transmission lines 231A–235A, 231B–235B. At this time, as the time delay of first set of the transmission lines 231A–235A increase to a predetermined amount, that of the other set of the transmission lines 231B–235B decrease to the predetermined amount, because the first and the second sets of the transmission lines 231A–235A, 231B–235B are arrayed symmetrically.

Figure 17A:
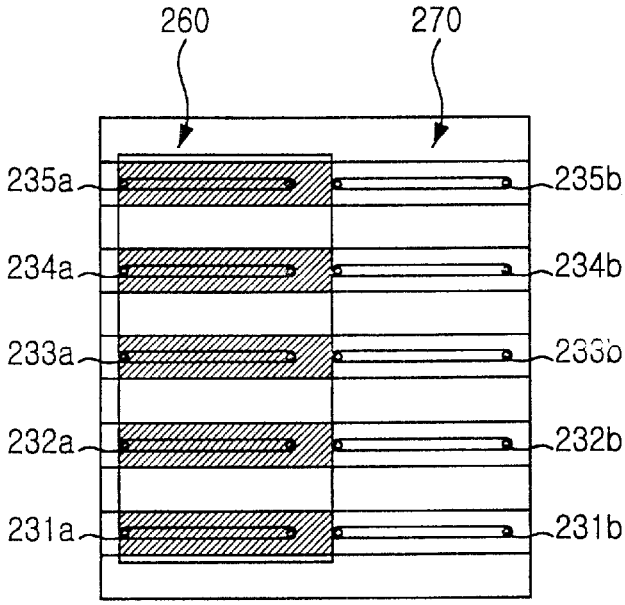
FIGS. 17A to 17C are schematic views setting forth a mechanism of the signal process apparatus of the fourth preferred embodiment of the present invention.
Figure 17B:
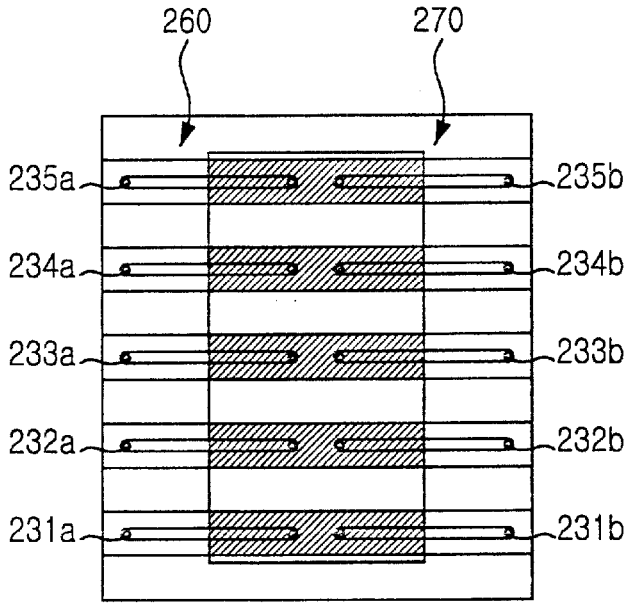
Figure 17C:
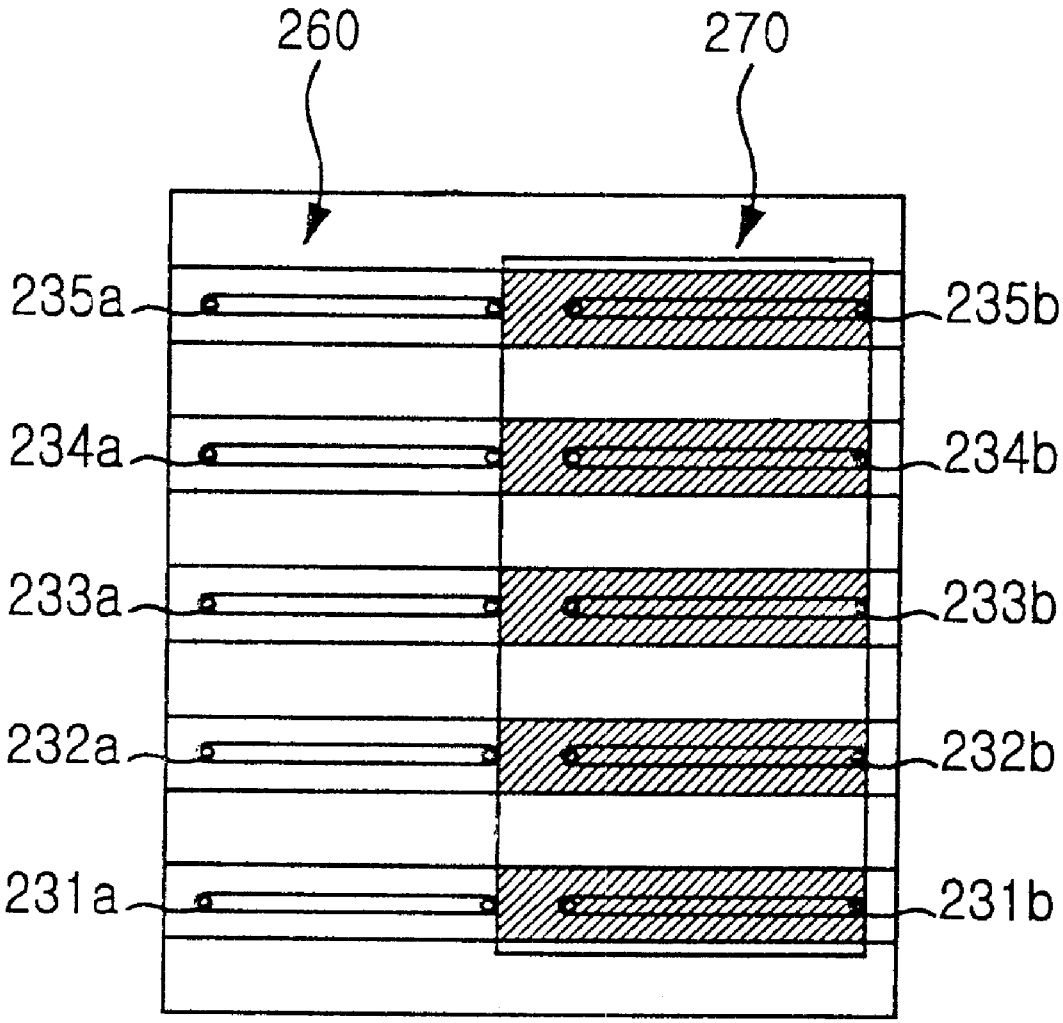
Figure 18:
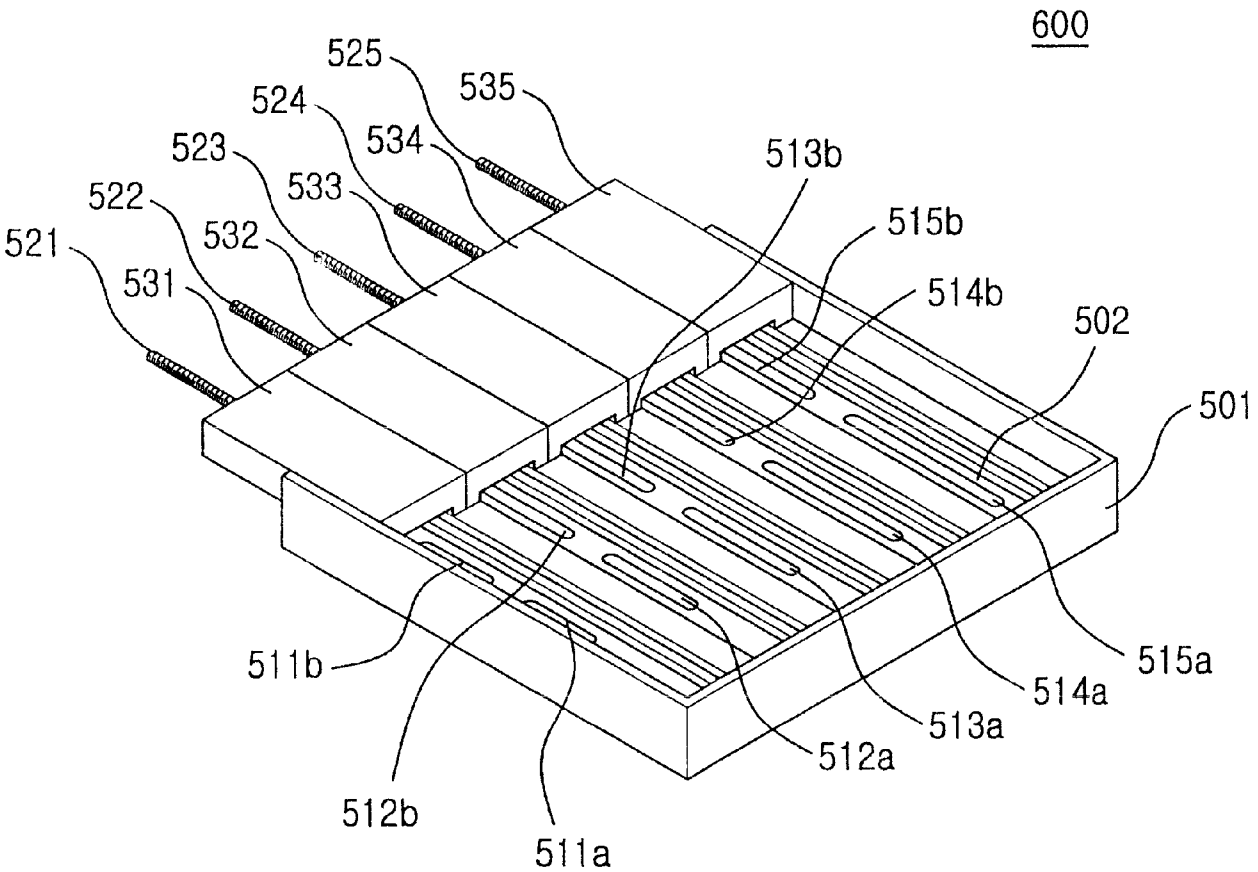
FIG. 18 is a perspective view of a signal process apparatus in accordance with a fifth preferred embodiment of the present invention.

For example as shown in FIGS. 17A to 17C, if the first set of the transmission lines 231A–235A are positioned within the region of the first dielectric portion 260 entirely and the second set of the transmission lines 231B–235B within the second dielectric portion 270 entirely while the first dielectric portion 260 moves along the guide rails 201A, the phase shift and the time delay at the first set of the transmission lines 231A–235A become minimum values, but those at the second set of the transmission lines 231B–235B become maximum values, as shown in FIG. 17A. Furthermore, if the first and the second sets of the transmission lines 231A–235A, 231B–235B are positioned within half parts of the first and the second dielectric portions 260, 270, the phase shift and the time delay at the first and the second transmission lines 231A–235A, 231B–235B are same each other, as shown in FIG. 17B. By contrast with FIG. 17A, if the first and the second transmission lines 231A–235A, 231B–235B are positioned within the second and the first dielectric portions 270, 260 entirely, the phase shift and the time delay at the first set of the transmission lines 231A–235A have the maximum values and those at the second set of the transmission lines 231B–235B have the minimum values, as shown in FIG. 17C. Thus, the phase shift and the time delay can be modulated by positioning the dielectric portions 270, 260 over the transmission lines 231A–235A, 231B–235B appropriately.

Meanwhile, if the first dielectric portion 260 is substituted by an absorber capable of absorbing a radio wave, e.g., made of ferrite, the signal process apparatus 500 of the present invention may be used as an attenuator. Namely, while the signals inputted through the input connectors 211–220 are transmitted through the transmission lines 231A–235A, 231B–235B, the inputted signals are absorbed by the absorber so that the signals are attenuated by a predetermined amount.

Referring to FIGS. 18 and 19A to 19C, there is shown a signal process apparatus 600 in accordance with a fifth preferred embodiment of the present invention. In the fifth embodiment, the others are same to the fourth embodiment but the lengths of the transmission lines 511A–515A, 511B–515B are different thereamong. Here, it is noted that the length ratio of the transmission lines 511A–515A, 511B–515B formed on the circuit board 502 is identical to that of longitudinal lengths of the dielectric materials 541–545 and a pitch ratio of the transportation shafts 521–525. For example, if the length ratio of the transmission lines 511A–515A, 511B—511B is 2:3:4:5:6, the longitudinal length ratio of the dielectric materials 541–545 and the pitch ratio of the transportation shafts 521–525 should be 2:3:4:5:6. The length ratio, however, is not limited to this specified ratio so that the other values may be arbitrarily selected according to various conditions.

Figure 19A:
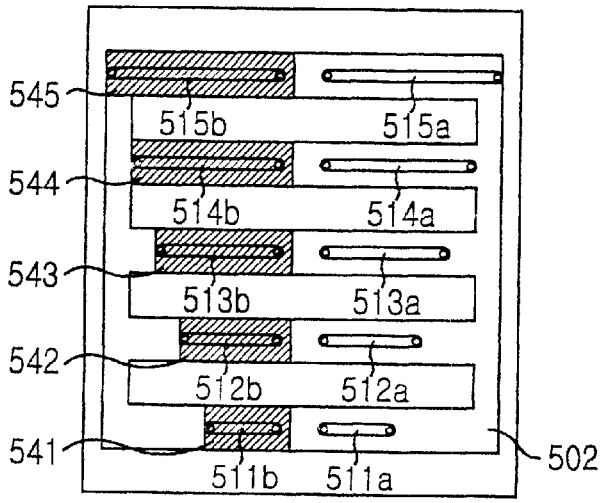
FIGS. 19A to 19C are cross sectional views setting forth a mechanism of the signal process apparatus of the fifth preferred embodiment of the present invention.
Figure 19B:
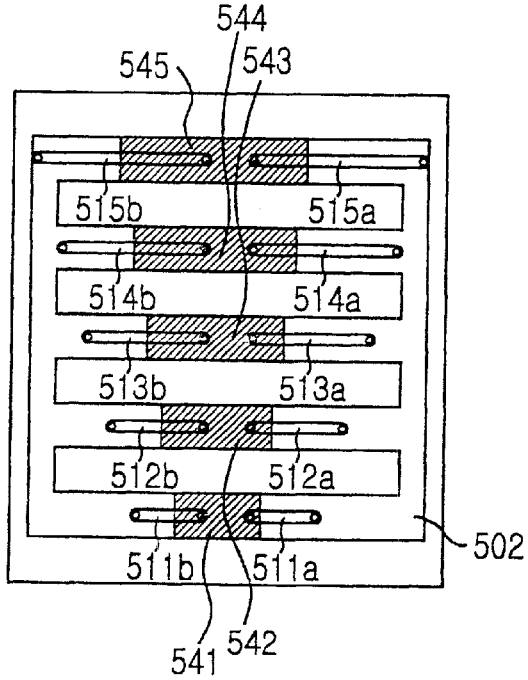
Figure 19C:
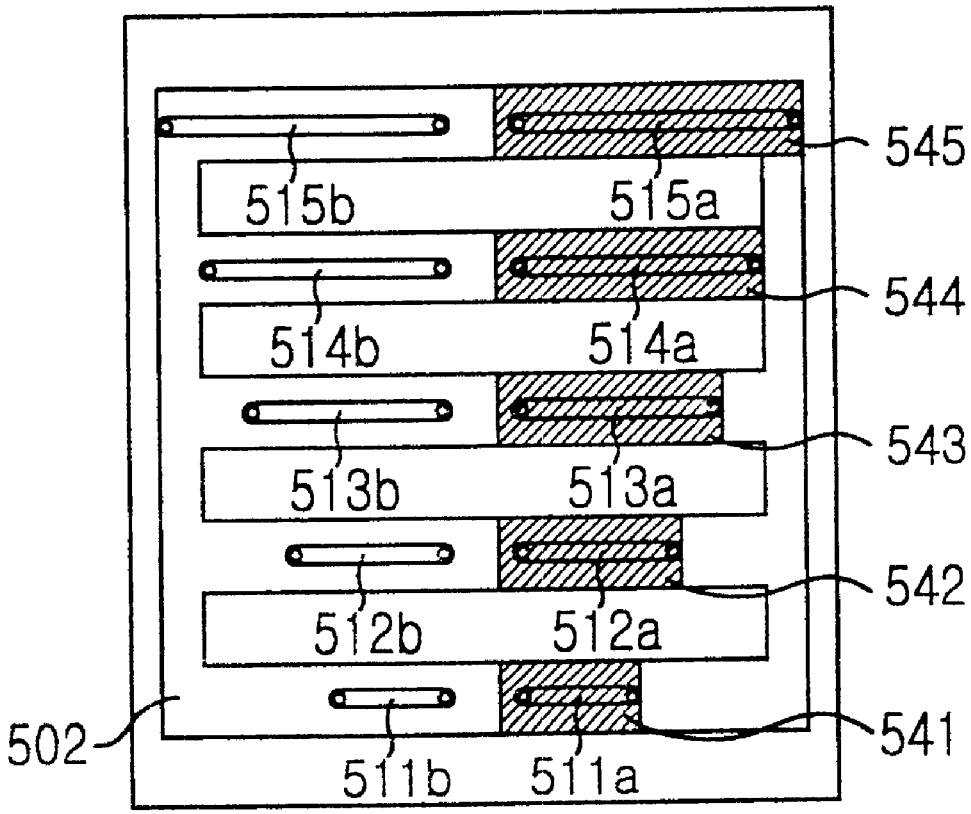

The mechanism of the fifth embodiment is illustrated in more detail hereunder. When the transportation shafts 521–525 are rotated by an outer power supplying equipment (not shown), the mobile plates 531–535 move linearly over the transmission lines 511A–515A, 511B–515B so that electrical lengths of the transmission lines 511A–515A, 511B–515B are changed continuously. That is, phases of the inputted signals are shifted and the time delay occurs while the signals are transmitted to the output connectors (not shown) after passing through the transmission lines 511A–515A, 511B–515B. At this time, since the length ratio of the transmission lines 511A–515A, 511B–515B, the longitudinal length ratio of the dielectric materials 541–545 and the pitch ratio of the transportation shaft 521–525 are identical thereamong, the changing rate of the phase shift and the time delay of each transmission line at the first set of the transmission lines 511A–515A are same thereamong. In addition, an increase or a decrease rate at the first set of the transmission lines 511A–515A are same to the decrease or increase rate at the second set of the transmission lines 511B–515B, as shown in FIGS. 19A to 19C. Moreover, if the dielectric materials 541–545 are substituted by absorbers capable of absorbing radio waves, e.g., made of ferrite, the signal process apparatus 600 of the present invention may be used as an attenuator, as described in the second. embodiment.

Figure 20:
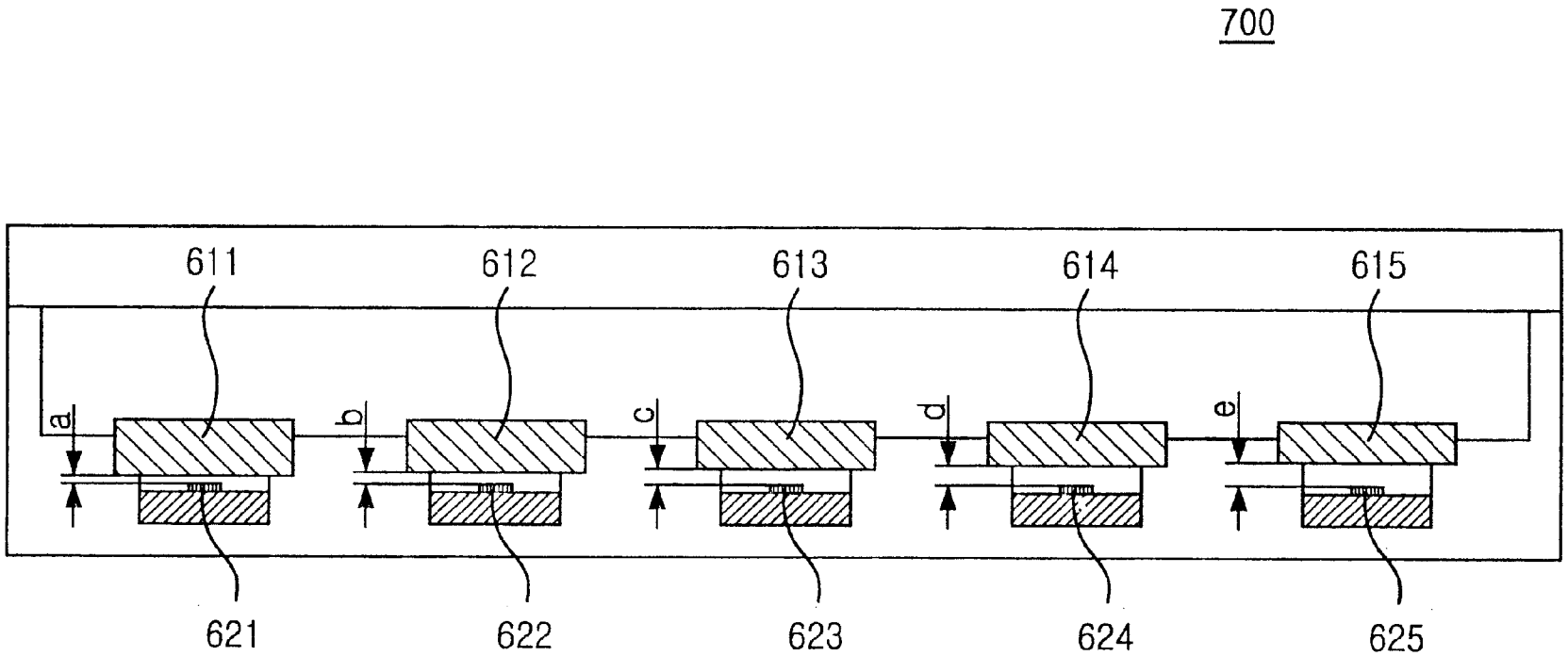
FIG. 20 is a cross sectional view of a signal process apparatus in accordance with a sixth preferred embodiment of the present invention.

Referring to FIG. 20, there is shown a signal process apparatus 700 in accordance with a sixth preferred embodiment of the present invention, which are same to the structure of the fourth embodiment except the gaps “a”, “b”, “c”, “d”, “e” between the transmission lines 621–625 and the dielectric materials 611–615. Therefore, the detail description of the structure and the mechanism will be abbreviated here. In the sixth embodiment, although the length of each dielectric material 611–615 is same, the electrical lengths of the transmission lines 621–625 are made to be different thereamong due to gap differentials between the transmission lines 621–625 and the dielectric materials 611–615. In other words, owing to the gap differentials, the dielectric constants of the dielectric materials 611–615 are also changed, whereby the electrical lengths of the transmission lines 621–625 is also changed. Therefore, the signal process apparatus 700 of the sixth embodiment is capable of being applied to a phase shifter for modulating the phases of multi-signals simultaneously.

Figure 21:
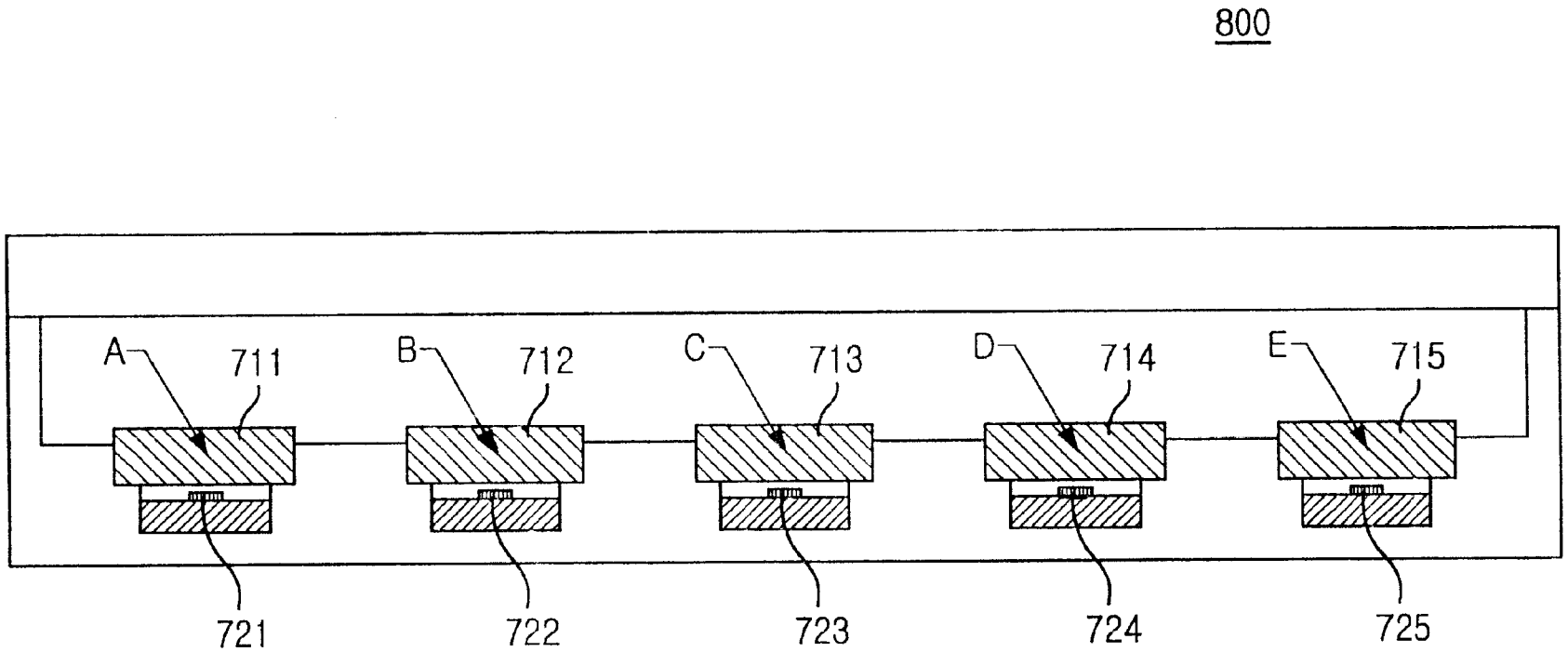
FIG. 21 is a cross sectional view of a signal process apparatus in accordance with a seventh preferred embodiment of the present invention.

Referring to FIG. 21, there is shown a signal process apparatus 800 in accordance with a seventh preferred embodiment of the present invention, which is similar to the fourth embodiment except that different kinds of the dielectric materials 711–715 are used, wherein each of the dielectric materials 711–715 has a dielectric constant different from each other. The detail description of the structure and the mechanism will be abbreviated here. However, in the seventh embodiment, although the other factors are same to the fourth embodiment, the electrical lengths of the transmission lines 721–725 are made to be different thereamong due to the different kinds of the dielectric materials 711–715. Thus, the signal process apparatus 800 of the seventh embodiment is also capable of being applied to a phase shifter for modulating the phases of multi-signals simultaneously.

By using aforementioned properties, the signal process apparatuses 200, 300, 400, 500, 600, 700, 800 of the present invention may be applied to an antenna. Generally, the antenna of a base station for use in a mobile communication system is installed on a rooftop of a high building, so that a position of the antenna may be changed by a typhoon and the like. The change of the position makes an angle of a radiative beam distorted so that a range of a service area may be changed, eventually. Therefore, the angle of the radiative beam should be adjusted physically or mechanically.

However, because this conventional method is only to shift the antenna at a predetermined angle physically or mechanically, it is difficult for a delicate adjustment and it takes a long time to adjust the distorted angle, and further lots of endeavors are needed.

Meanwhile, by using the signal process apparatuses 200, 300, 400, 500, 600, 700, 800 of the present invention, this matter can be easily solved. That is, because the antenna has a plurality of radiative devices, it should be necessary to control plenty of phases of signals simultaneously at a predetermined rate for adjusting the distorted angle. Since the signal process apparatus 200, 300, 400, 500, 600, 700, 800 of the present invention can modulate multi-signals inputted thereto simultaneously, this apparatus can be applied effectively to an antenna system.

While the present invention has been described with respect to certain preferred embodiments only, other modifications and variation may be made without departing from the spirit and scope of the present invention as set forth in the following claims.

What is claimed is:

1. A signal process apparatus for shifting phases of N number of signals input thereto, N being a positive integer, comprising:

a dielectric member provided with a first portion and a second portion, wherein a dielectric constant of the first portion is different from a dielectric constant of the second portion;

N number of transmission lines positioned opposite the dielectric member for transmitting the signals, wherein each signal is input to one end of a corresponding transmission line;

a mover that moves the dielectric member with respect to the transmission lines to shift phases of the signals after passing through the transmission lines; and a metal plate provided with a first part and a second part on which the transmission lines are formed.

2. The signal process apparatus of claim 1, wherein N number of the transmission lines are formed on the first part.

3. The signal process apparatus of claim 1, wherein N/2 number of transmission lines are formed on the first part and N/2 number of transmission lines are formed on the second part.

4. The signal process apparatus of claim 3, wherein the transmission lines of the first part are arranged symmetric with the transmission lines of the second part.

5. The signal process apparatus of claim 4, wherein each of the transmission lines is formed in a shape of an open loop.

6. The signal process apparatus of claim 4, wherein each of the transmission lines is formed in a shape of an arc.

7. The signal process apparatus of claim 1, wherein each of the first portions and the second portions is formed in a shape of a semicircle.

8. The signal process apparatus of claim 7, wherein the first part and second part of the metal plate are shaped similar to the first portion and the second portion of the dielectric member, respectively.

9. The signal process apparatus of claim 1, wherein the first portion comprises ceramic and the second portion comprises air.

10. The signal process apparatus of claim 1, wherein if the dielectric member comprises ferrite, the signal process apparatus is utilized as an attenuator to attenuate amplitudes of the input signals.

11. The signal process apparatus of claim 1, wherein the input signals are processed simultaneously.

12. The signal process apparatus of claim 1, wherein each of the transmission lines are electrically shielded to prevent the input signals from interfering with each other.

13. The signal process apparatus of claim 1, wherein each of the transmission lines is in the form of a straight line.

14. The signal process apparatus of claim 13, wherein each of the first portions and the second portions is in the form of a rectangle.

15. The signal process apparatus of claim 14, wherein the mover moves the dielectric members in a longitudinal direction of the transmission lines.

16. A signal process apparatus for shifting phases of N number of signals input thereto, N being a positive integer, comprising:

a dielectric member provided with a first portion and a second portion, wherein a dielectric constant of the first portion is different from a dielectric constant of the second portion;

N number of transmission lines positioned opposite the dielectric member for transmitting the signals, wherein each signal is input to one end of a corresponding transmission line; and a mover that moves the dielectric member with respect to the transmission lines to shift phases of the signals after passing through the transmission lines;

wherein the mover rotates the dielectric member with respect to an axis perpendicular to a surface of the dielectric member and parallel to the transmission lines.

17. The signal process apparatus of claim 16, wherein if electrical lengths of the transmission lines of the first part are increased to a first predetermined value, the electrical lengths of the transmission lines of the second part are decreased to a second predetermined value.

18. The signal process apparatus of claim 16, wherein the mover includes a disk provided with a shaft on one surface for application of a rotational force by the disk, and a first section and a second section on the other surface, a height of the first section being smaller than a height of the second section.

19. The signal process apparatus of claim 18, wherein the dielectric member is attached to the first section, the thickness of the dielectric member is slightly larger than a difference in the thickness between the first section and the second section such that an air gap exists between the second section and the metal plate after the dielectric member is connected to the metal plate.

20. A signal process apparatus for shifting phases of N number of signals input thereto, N being a positive integer, comprising:

a dielectric member provided with a first portion and a second portion, wherein a dielectric constant of the first portion is different from a dielectric constant of the second portion;

N number of transmission lines positioned opposite the dielectric member for transmitting the signals, wherein each signal is input to one end of a corresponding transmission line; and a mover that moves the dielectric member with respect to the transmission lines to shift phases of the signals after passing through the transmission lines;

a housing that covers the dielectric member and the transmission lines, the housing being provided with 2N number of guide holes;

a plurality of input connectors electrically connected to ends of the transmission lines through N number of the guide holes; and a plurality of output connectors electrically connected to the other ends of the transmission lines through N number of the guide holes.

21. A signal process apparatus for phase-shifting a N number of signals input thereto, N being a positive integer, comprising:

a lower housing provided with a plurality of trenches;

a plurality of substrates, each of the substrates being provided with a transmission line;

a plate provided with a number of dielectric members, each dielectric member positioned in a trench facing a corresponding transmission line and provided with a first portion and a second portion, wherein a dielectric constant of the first portion is different from a dielectric constant of the second portion; and a mover that moves the plate with respect to the transmission lines to give a different phase to each of the signals after passing through the corresponding transmission line.

22. The signal process apparatus of claim 21, wherein each of the trenches is in the form of a ring.

23. The signal process apparatus of claim 22, wherein each of the transmission lines is in the form of an arc, each of the first portions of the dielectric members in the form of an arc and each of the second portions of the dielectric members is in the form of an arc.

24. The signal process apparatus of claim 21, further comprising an insulating layer between the plate and the lower housing to electrically isolate the plate from the lower housing.

25. The signal process apparatus of claim 21, wherein the number of trenches is N/2.

26. The signal process apparatus of claim 21, wherein the number of trenches is N.

* * * * *